United States Patent [19]

Bullock, III

[11] Patent Number: 4,484,687

[45] Date of Patent: Nov. 27, 1984

[54] TAMPER-PROOF CONTAINER CLOSURE FOR USE WITH CONTAINER NECKS SEALED WITH FOIL SEAL DISCS

[75] Inventor: Joseph J. Bullock, III, Atherton, Calif.

[73] Assignee: Three Sisters Ranch Enterprises Ptnrshp, San Carlos, Calif.

[21] Appl. No.: 517,666

[22] Filed: Jul. 27, 1983

[51] Int. Cl.[3] ..... B65D 41/48

[52] U.S. Cl. ..... 215/256

[58] Field of Search ..... 215/256, 224, 274

[56] References Cited

U.S. PATENT DOCUMENTS

| | | | |
|---|---|---|---|
| 3,940,004 | 2/1976 | Faulstich | 215/256 |
| 4,162,736 | 7/1979 | Faulstich | 215/256 |
| 4,166,552 | 9/1979 | Faulstich | 215/256 |
| 4,417,666 | 11/1983 | Roberts | 215/256 |
| 4,438,857 | 3/1984 | Bullock | 215/256 |

*Primary Examiner*—George T. Hall

*Attorney, Agent, or Firm*—Julian Caplan

[57] ABSTRACT

To prevent tampering with the contents of containers for pharmaceuticals and other products, a plastic cap which is an improvement upon U.S. Pat. Nos. 3,338,446 and 4,166,552. The neck of the container is sealed with a commercially available foil seal; the cap is dimensioned so that the foil seal is inserted inside the cap prior to its being applied to the container. The dimensions of the cap accommodate the foil seal yet the snap-on and the tamper-proof features of the cap are maintained. At intervals, scorelines are formed extending upward from the bottom of the cap skirt; these tear if one attempts to pry the cap off the container and are visible evidence of the tampering. A flexible, thin flange projecting from the periphery of the cap is used to removed the cap in its reclosure mode; however, this flange has a sharp corner where it meets the cap skirt so that if one attempts to use the flange to pry off the cap when in its original sealing mode, the flange tears and gives additional evidence of tampering.

20 Claims, 9 Drawing Figures

TAMPER-PROOF CONTAINER CLOSURE FOR USE WITH CONTAINER NECKS SEALED WITH FOIL SEAL DISCS

This invention relates to a new and improved tamper-proof closure for use with container necks sealed with foil seal discs. The present invention comprises an improvement upon U.S. Pat. No. 4,166,552 and other prior patents of assignee.

Foil liner seals have been used to close the necks of containers as a means to assist in detecting tampering with the contents of the container. Such seals are commercially available, are applied to the container neck and are caused to adhere thereto by induction heating or other means. In a preferred embodiment of this invention, such commercially available foil liner seals are used. To facilitate installation on the container neck, the seal is initially inserted into the cap of the present invention. After the cap has been applied, the foil seal comes into intimate contact with the neck. Induction heating or other means then causes the foil seal to adhere to the neck finish. One of the features of the cap hereinafter described is the presence of an internal bead near the upper end of the skirt. This bead holds the foil liner seal in place prior to the cap being applied to the container.

Another feature of the present invention is the fact that the locking beads on the interior of the cap skirt may be either interrupted or continuous. Interrupted beads, as set forth in U.S. Pat. No. 4,166,552, facilitate applying the cap to the container neck without likelihood of the cap splitting. Interrupted upper beads also make it easier to apply and remove the reclosure cap which results from tearing off the lower end of the skirt.

Another feature of the invention is the provision of one or more vertical scorelines extending up from the lower edge of the skirt. If one attempts to pry the cap off the container without removing the lower end of the skirt, the cap tends to tear along the vertical scorelines, revealing that an attempt has been made to tamper with the contents. Various configurations of vertical scorelines are hereinafter set forth.

A still further anti-tamper feature of the invention is the provision of a flange on the top of the cap which has a sharp corner at the juncture of the underside of the flange and the outer wall of the skirt. If one attempts to pry the cap off the neck without removing the lower end of the skirt, the flange tears from the aforesaid corner upwardly and inwardly. This tear frustrates the attempt to use the flange as a means for prying off the cap and also reveals that an attempt has been made to tamper with the contents.

Alternatively, the flange on the exterior of the cap may be slanted at about a 45° angle upwardly outwardly. This deters one digging the fingernails under the flange in order to remove the cap.

Still another tamper-proof feature of the cap is the fact that the container neck is provided with an outwardly extending ring against which the lower edge of the skirt tightly abuts. Again, this makes it difficult, if not impossible for one to dig one's fingernails under the edge of the skirt in order to pry the cap off the neck. The aforementioned ring also functions as a "bumper" ring which is engaged by automatic loading machinery to lift the filled container and load the same into a box. The shape of the ring is subject to some variation as hereinafter explained. One additional function of the ring is to bend the tear tab which extends below the lower edge of the skirt outwardly, so that it is conveniently accessible when a patron wishes to rip the tear tab to remove the lower end of the skirt.

Other objects of the present invention will become apparent upon reading the following specification and referring to the accompanying drawings in which similar characters of reference represent corresponding parts in each of the several views.

Figure 2:
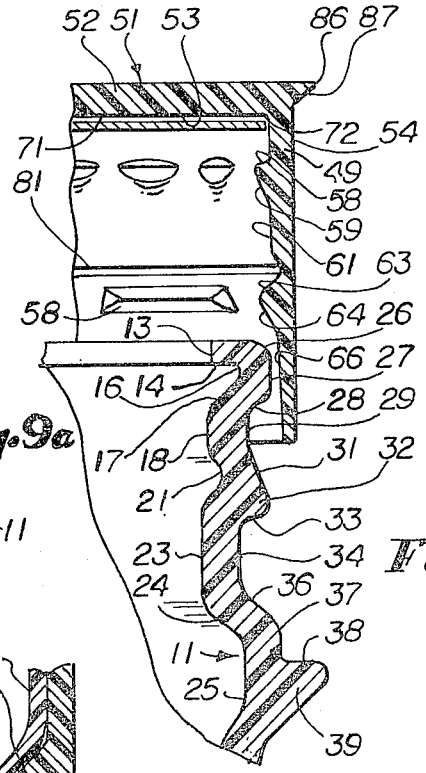
FIG. 2 is an enlarged vertical sectional view of a portion of a cap and neck prior to installation of the cap.
Figure 3:
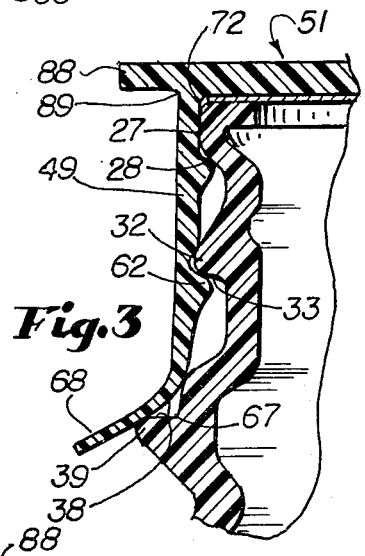
FIG. 3 is a view similar to FIG. 2 showing the cap and neck assembled.

In FIGS. 2 and 3 is shown one form of container neck with which the present invention may be used. This neck is similar to that shown in prior U.S. Pat. No. 4,166,552. Neck 11, therefore, has a thin inward extending horizontal top flange 12 which terminates in a substantially vertical top edge 13. Below edge 13 of flange 12 is a substantially horizontally outwardly extending surface 14 which terminates in a top internal groove 16. Below groove 16, the inside wall of the neck 11 slants downwardly-outwardly in a surface 17 terminating in a vertical wall 18. Below wall 18 is a second internal groove 21 and below the groove 21 is another vertical wall 23 which terminates in an outwardly-downwardly slanted wall 24 which, in turn, terminates in an internal vertical wall 25. The internal structure of the neck 11 is subject to considerable variation.

Directing attention next to the exterior of the neck 11, the top corner 26 where flange 12 originates is slightly rounded and merges into top external vertical wall 27. There is a slightly downwardly-inwardly slanted shoulder 28 at the lower edge of wall 27 which continues inward and merges into the second external vertical wall 29 which is of lesser diameter than wall 27. Below wall 29 is a downwardly-outwardly slanted wall 31 which comprises the top surface of external locking bead 32. The lower edge of bead 32 comprises a substantially horizontal shoulder 33. Below shoulder 33 is a third external vertical wall which is of lesser diameter than wall 29. Below wall 34 is an outward slanted wall 36 which terminates in fourth external vertical wall 37 which has a diameter greater than wall 27. In the form of neck shown in FIGS. 2 and 3, there is a horizontal outwardly extending shoulder 38 on the lower edge of wall 37, the shoulder 38 forming the top surface of a bumper ring 39. Ring 39 is used with certain types of automatic loading machinery and serves as a means whereby grippers on the loading machine lift the container and deposit it in a box, on a pallet, etc. The ring 39 prevents the gripper rings from contacting the cap 51 on neck 11, and thus reduces the chance of the cap being pulled off the neck during loading.

As hereinafter explained, the shape of the exterior of the neck is subject to variation.

Figure 1:
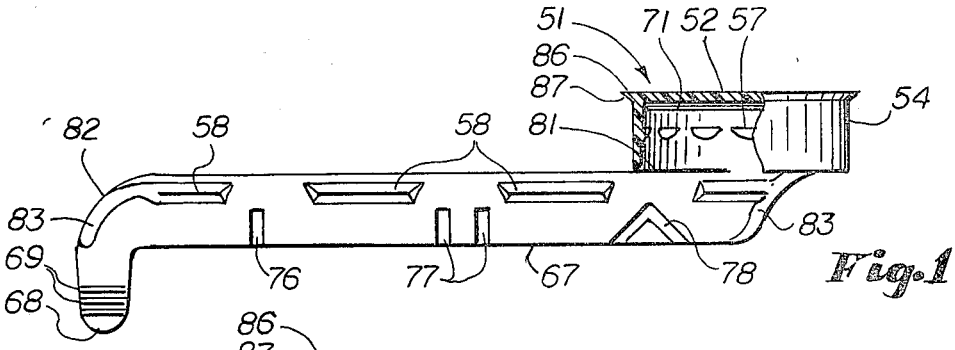
FIG. 1 is a side elevational view partly broken away to reveal internal construction showing the lower end of the skirt partially torn away.

Directing attention now to cap 51, again the structure of the cap is subject to variation and in its general principles resembles the commercially highly successful cap of assignee's licensee. In the preferred embodiment shown in FIGS. 1–3, cap 51 has a preferably flat top disc 52 on which a label or printed matter may be applied. The bottom 53 of disc 52 is also preferably flat. Depending from disc 52 is a cap skirt 49 having an external wall 54. In the preferred embodiment of the wall 54, the surface is smooth and substantially vertical. The inside surface of the cap skirt 49 has a top internal vertical wall 56. Top locking bead means are provided on the interior of the skirt 49 below the wall 56 positioned to lock under the shoulder 28 in the assembled condition of the cap and neck. The bead means 57*a* may be continuous (see FIG. 1A) or, as shown in FIGS. 1, 2 and 3, may be interrupted. The interrupted bead means has a substantially horizontal top surface 58 and downwardly slanted surface 59 which terminates in a second internal vertical wall 61.

Second or lower bead means 58 may be provided. Again, these bead means may be continuous as shown in the bead 58*a* in FIG. 1A, or interrupted as shown in FIGS. 1, 2 and 3. The interrupted bead sections 58 are longer than the sections 57. The top surface 63 is slanted downwardly inwardly at a fairly acute angle. The lower surface 64 slants downwardly outwardly.

Below the bead means 58 is a third vertical wall 66 which extends down to the bottom edge 67 of the skirt 49. At one location along the bottom edge 67 there is a depending tear tab 68 which may have gripper ridges 69 on its interior surface.

As will be understood with reference to the aforementioned prior patent, the slanted surfaces 59 and 64 facilitate cap 51 sliding over corner 66 and surface 61 without tearing the skirt. The fact that the beads are interrupted as shown in FIG. 1 enables the skirt to expand more readily than if a continuous bead is used as in FIG. 1A, again overcoming any tendency of the cap to split.

Figure 1A:
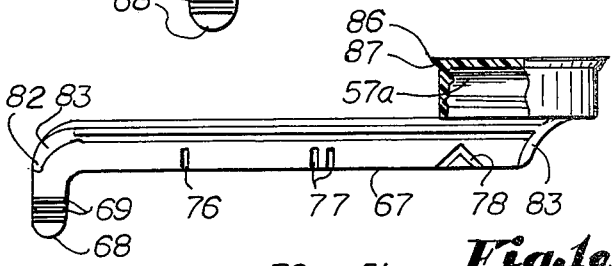
FIG. 1A is a view similar to FIG. 1 of a modification.

Spaced slightly above lower bead means 58 is an internal horizontal scoreline 81. Extending upward from the bottom edge 67 of the cap 51 in immediate proximity to the tear tab 68 is a curved or slanted scoreline 82 which merges with the scoreline 81. In a preferred embodiment, reinforcements 83 on either side of scoreline 82 are provided, such reinforcements being thickening of the wall thickness of the skirt. As best shown in FIGS. 1 and 1A, the scoreline 82 curves upwardly and to the right from the left side of the tab 68. However, the line 82 might also curve upwardly and to the left of the right edge of the tab 68.

Figure 5:
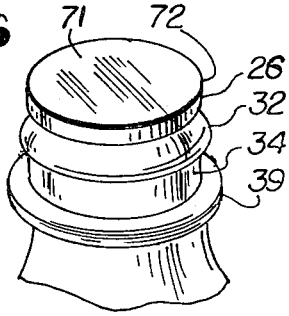
FIG. 5 is a perspective view showing a seal disc on a bottle neck after the cap has been removed.

A particular feature and advantage of the present invention is that, prior to the cap 51 being applied to the neck 11, a foil sealing disc 71 of a commercially available type is applied to the underside of the top cap disc 52. The bead sections 57 assist in keeping the disc 71 in place prior to the cap being installed. When the cap is installed, as best shown in FIG. 5, the seal 71 seats on the flange 12. Rounded outer edge 72 fits over the rounded corner 26. Adhesives or heating means cause the disc 71 to adhere to the flange 12. If an attempt is made to tamper with the contents of the container, such tampering can usually be detected by examination of the condition of the disc 71.

An additional feature to detect tampering with the contents of the container is best shown in FIGS. 1 and 1A. Three alternative or supplemental means are illustrated therein. Thus, a single vertical scoreline 76 may extend up from the bottom edge 67 to the region of the bead means 58. If interrupted beads as illustrated are used, the scoreline 76 is preferably intermediate two sections. Thus, if one attempts to pry up the lower edge 67, the skirt fractures along the scoreline 76, revealing tampering. An alternate means consists of two spaced apart parallel vertical scorelines 77. A still further alternate is a triangularly shaped scoreline 78. In all these instances, if one attempts to pry up the lower edge of the skirt, the scoreline tears.

Figure 6:
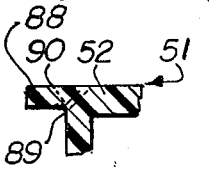
FIG. 6 is an enlarged fragmentary view showing one form of peripheral flange and indicating the line at which it will tear if an improper attempt is made to remove the cap.

As shown in FIGS. 1 and 2, a horizontal peripheral flange 86 projects out from the disc 52 at the upper end of the wall 54. The underside 87 slants upwardly-outwardly at an angle of about 45°. Thus, it is difficult for one to pry the cap 51 off the neck 11 while the skirt is intact. An alternate structure is shown in FIGS. 3 and 6. In this form, the flange 88 is rectangular in cross section and there is a sharp corner 89 where the underside of the flange 88 intersects the wall 54. If an attempt is made to pry upward on the flange 88 while the skirt is intact, because of the sharp corner 89 the flange tears approximately along the line 90. This prevents removing the cap, but also indicates that an attempt has been made to tamper with the contents.

An additional anti-tampering feature is shown in FIG. 3. Thus, the bottom edge 67 of the skirt of the cap fits tightly against the shoulder 38 of the bumper ring 39. It is difficult, or impossible, for one to get one's fingernails under the edge 67 to pry the cap off while the skirt is intact. In the region where the tear tab 68 extends down below the lower edge 67, the cap flexes sufficiently so that the tab bends outwardly. It is relatively easy for the patron to grip the tear tab 68 when it extends outwardly away from the container neck in the fashion shown in FIG. 3. If the tear tab 68 were to lie flat against a vertical surface of the neck, then it would be necessary to pry the tab 68 outward either with the fingernails or an implement.

Figure 7:
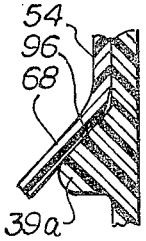
FIG. 7 is a fragmentary sectional view of the lower end of a skirt and the adjacent neck structure.

FIG. 7 shows an alternate construction, wherein there is a slanted surface 96 of the bumper ring 39*a*. Again, the tab 68 slants outwardly and is readily gripped. Further, the slanted surface 96 makes it difficult to insert one's fingernails under the lower edge of the cap skirt.

Figure 8:
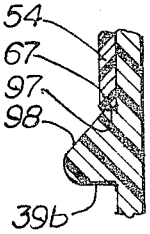
FIG. 8 is a view similar to FIG. 7 of a modified neck structure.
Figure 4:
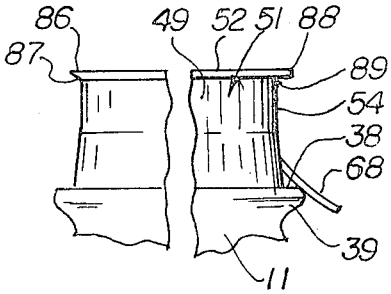
FIG. 4 is a composite side elevational view of a cap seated on a neck, the view being broken away to show one form of peripheral cap flange on one side and another form on the other.

FIG. 8 shows a further preferred embodiment. In this form of the invention, the bumper ring 39*b* has a very narrow horizontal top shoulder 67 of a width approximately equal to the thickness of the wall 54*b*. This is an even further improved shape preventing one's fingernails from getting under the edge of the skirt. Beyond shoulder 67 surface 98 slants downwardly-outwardly.

Figure 9A:
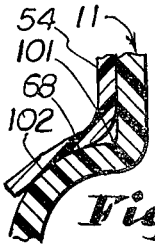
FIG. 9A is a view similar to FIG. 9 showing the position of the cap tear tab in the assembly of FIG. 9.
Figure 9:
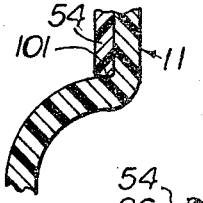
FIG. 9 is a view similar to FIG. 7 showing the cap applied to a container of different construction.

FIG. 9 illustrates a container shape somewhat different from those previously described. The bumper ring shown in FIGS. 2–5, 7 and 8 is eliminated. Instead there is a short horizontal outwardly extending shoulder 101 at the lower end of the neck 11 which merges into an outwardly and downwardly curved outer wall 102. As shown in FIG. 9, the bottom edge 67 of the skirt rests on the shoulder 101. The tear tab 68, however, slants outwardly and is tangent to the curved surface 102.

What is claimed is:

1. A plastic cap for sealing container necks having a top finish comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second score line, whereby by pulling said tear means the bottom of said skirt may be torn off by tearing upward along said second scoreline and then around said first scoreline, and a seal disc underneath said top disc inside said skirt and above said first bead means, whereby when said cap is applied to said neck said seal disc fits tightly against said top finish and is sealable with said top finish so that access to said neck cannot be obtained without tearing open said seal disc, said first and second bead means being engageable with third and fourth bead means, respectively, on the exterior of said neck to prevent removal of said cap without tearing off the portion of said skirt below said first scoreline.

2. A cap according to claim 1 in which said seal disc is foil and adheres to said neck finish upon being heated.

3. A cap according to claim 1 which further comprises a thin flexible peripheral flange around the top of the exterior of said skirt, said flange being flexible enough to flex to prevent removal of said cap when said skirt is intact and being stiff enough for use in prying off said cap when said portion of said skirt below said first scoreline is torn off.

4. A cap according to claim 3 in which the underside of said flange slants downward-inward to merge with the exterior of said skirt.

5. A cap according to claim 3 in which the underside of said flange extends inward to form a sharp corner at the exterior fo said skirt, whereby if one attempts to pry up on said flange said cap tears upward-inward from said corner to indicate tampering.

6. A cap according to claim 1 which said skirt is formed with a plurality of internal score lines extending upward from the bottom edge of skirt, whereby if one attempts to pry up the lower edge of said skirt, said skirt tears at at least one of said last-mentioned scorelines to indicate tampering.

7. A cap according to claim 6 in which at least two of said last-mentioned scorelines are in close proximity and perpendicular to said bottom edge of said skirt.

8. A cap according to claim 6 in which at least two of said last-named scorelines slant upward from the bottom edge of said skirt and toward each other to merge together.

9. A plastic cap for sealing a container neck having a top finish comprising a top disc having a depending skirt, said skirt having first bead means extending around the inside of said skirt spaced downward from said disc, second bead means extending around the inside of said skirt spaced from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, a thin, flexible flange around the top of the exterior of said skirt, said flange being flexible enough to flex to prevent removal of said cap when said skirt is intact and being stiff enough for use in prying off said cap when said portion of said skirt below said first scoreline is torn off.

10. A cap according to claim 9 in which the underside of said flange slants downward-inward to merge with the exterior of said skirt.

11. A cap according to claim 9 in which the underside of said flange extends inward to form a sharp corner at the exterior of said skirt, whereby if one attempts to pry up on said flange said cap tears upward-inward from said corner to indicate tampering.

12. A plastic cap for sealing a container neck having a top finish comprising a top disc having a depending skirt, said skirt have first bead means extending around the inside of said skirt spaced downward from said disc, second bead means extending around the inside of said skirt spaced downward from said first bead means, a first scoreline extending circumferentially around said skirt, spaced between said first and second bead means, a second scoreline extending up from the bottom edge of said skirt and merging with said first scoreline, tear means on said bottom edge adjacent said second score line, whereby by pulling said tear means the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said skirt being formed with a plurality of internal scorelines extending upward from the bottom edge of skirt, whereby if one attempts to pry up the lower edge of said skirt said skirt tears at least one of said last-mentioned scorelines to indicate tampering.

13. A cap according to claim 12 in which at least two of said scorelines are in close proximity and perpendicular to said bottom edge of said skirt.

14. A cap according to claim 12 in which at least two of said last-named scorelines slant upward from the bottom edge of said skirt and toward each other to merge together.

15. A cap according to claim 1 which further comprises in combination a container neck having said external third and fourth bead means on its exterior in a position when engaged with said first and second bead means to force said seal disc into tight engagement with said neck finish, said neck being formed with an external shoulder positioned to fit tightly under the lawer edge of said skirt to impeded attempts to pry the lower edge of said skirt upward.

16. A cap according to claim 14 in which the width of said shoulder is approximately equal to the thickness of said skirt, said neck slanting downward-outward beyond said shoulder.

17. A cap according to claim 14 in which said neck curves outward beyond said shoulder.

18. In combination, a plastic cap and a container neck said cap comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said container neck comprising a top neck finish, external third and fourth bead means on the exterior of said neck in a position to engage said first and second bead means and an external shoulder positioned to fit tightly under the lower edge of said skirt to impede attempts to pry the lower edge of said skirt upward.

19. A combination according to claim 14 in which the width of said shoulder is approximately equal to the thickness of said skirt, said neck slanting downward-outward beyond said shoulder.

20. A combination according to claim 14 in which said neck curves outward-downward beyond said shoulder.

* * * * *

UNITED STATES PATENT AND TRADEMARK OFFICE

CERTIFICATE OF CORRECTION

PATENT NO. : 4,484,687

DATED : November 27, 1984

INVENTOR(S) : Joseph J. Bullock III

It is certified that error appears in the above-identified patent and that said Letters Patent is hereby corrected as shown below:

Column 6:
Claim 15, line 7, change "lawer" to --lower--.

Claim 16, line 1, change "14" to --15--.

Claim 17, line 1, change "14" to --15--.

Column 8:
Claim 19, line 1, change "14" to --18--.

Claim 20, line 1, change "14" to --18--.

Signed and Sealed this

Twenty-fourth Day of December, 1991

*Attest:*

HARRY F. MANBECK, JR.

*Attesting Officer*

*Commissioner of Patents and Trademarks*

US004484687B1

REEXAMINATION CERTIFICATE (3227th)

United States Patent [19] [11] B1 4,484,687

Bullock, III [45] Certificate Issued Jun. 17, 1997

[54] TAMPER-PROOF CONTAINER CLOSURE FOR USE WITH CONTAINER NECKS SEALED WITH FOIL SEAL DISKS

[75] Inventor: Joseph J. Bullock, III, Atherton, Calif.

[73] Assignee: Portola Packaging, Inc., San Jose, Calif.

Reexamination Request:
No. 90/004,213, Apr. 10, 1996

Reexamination Certificate for:

| | |
|---|---|
| Patent No.: | **4,484,687** |
| Issued: | **Nov. 27, 1984** |
| Appl. No.: | **517,666** |
| Filed: | **Jul. 27, 1983** |

Certificate of Correction issued Nov. 27, 1984.

[51] Int. Cl.[6] ..... B65D 41/48
[52] U.S. Cl. ..... 215/256
[58] Field of Search ..... 215/256, 232, 215/250, 252, 253

[56] References Cited

U.S. PATENT DOCUMENTS

| | | | |
|---|---|---|---|
| 2,987,206 | 6/1961 | Grussen | 215/250 |
| 3,142,403 | 7/1964 | Fox | 215/42 |
| 3,465,906 | 9/1969 | Wagner et al. | 215/253 |
| 3,871,544 | 3/1975 | Peyser | 215/225 |
| 3,940,004 | 2/1976 | Faulstich | 215/256 |
| 3,961,566 | 6/1976 | Westphal et al. | 93/36 B |
| 4,109,815 | 8/1987 | Collins, III | 215/232 |
| 4,162,736 | 7/1979 | Faulstich | 215/256 |
| 4,166,552 | 9/1979 | Faulstich | 215/256 |
| 4,378,892 | 4/1983 | Ochs et al. | 215/232 |
| 4,417,666 | 11/1983 | Roberts | 215/256 |
| 4,438,857 | 3/1984 | Bullock, III | 215/256 |

FOREIGN PATENT DOCUMENTS

| | | | |
|---|---|---|---|
| 460557 | 12/1991 | European Pat. Off. | 215/252 |
| 3025903 | 12/1981 | Germany | 215/252 |
| 1209395 | 10/1970 | United Kingdom | 215/252 |

*Primary Examiner*—Stephen P. Garbe

[57] ABSTRACT

To prevent tampering with the contents of containers for pharmaceuticals and other products, a plastic cap which is an improvement upon U.S. Pat. Nos. 3,338,446 and 4,166,552. The neck of the container is sealed with a commercially available foil seal; the cap is dimensioned so that the foil seal is inserted inside the cap prior to its being applied to the container. The dimensions of the cap accommodate the foil seal yet the snap-on and the tamper-proof features of the cap are maintained. At intervals, scorelines are formed extending upward from the bottom of the cap skirt; these tear if one attempts to pry the cap off the container and are visible evidence of the tampering. A flexible, thin flange projecting from the periphery of the cap is used to removed the cap in its reclosure mode; however, this flange has a sharp corner where it meets the cap skirt so that if one attempts to use the flange to pry off the cap when in its original sealing mode, the flange tears and gives additional evidence of tampering.

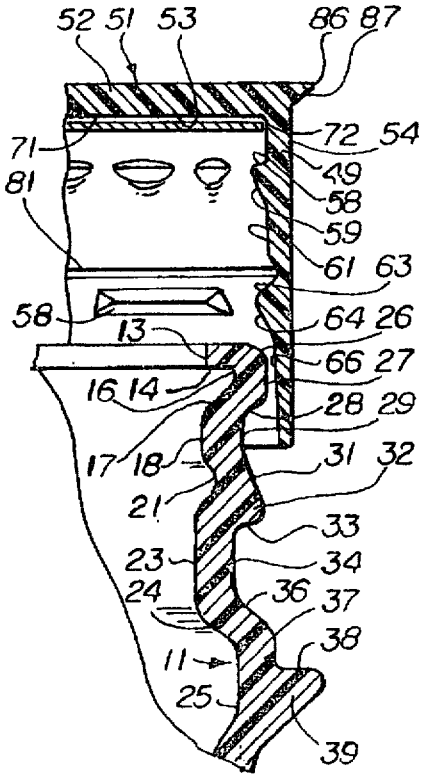

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12–14 is confirmed.

Claims 9–11 are cancelled.

Claims 1 and 18 are determined to be patentable as amended.

Claims 2–8, 15–17, 19, and 20, dependent on an amended claim, are determined to be patentable.

1. A plastic cap for sealing container necks having a top finish comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second score line, whereby by pulling said tear means the bottom of said skirt may be torn off by tearing upward along said second scoreline and then around said first scoreline, and a seal disc underneath said top disc inside said skirt and above said first bead means, whereby when said cap is applied to said neck said seal disc fits tightly against said top finish and is sealable with said top finish so that access to said neck cannot be obtained without tearing open said seal disc, said first and second bead means being engageable with third and fourth bead means, respectively, on the exterior of said neck to prevent removal of said cap without tearing off the portion of said skirt below said first scoreline, *said first bead means being located to assist in keeping said seal disc in place underneath said top disc prior to the cap being applied to a container neck.*

18. In combination, a plastic cap and a container neck said cap comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second scoreline, whereby by pulling said tear means the bottom of said skirt may be torn off by tearing upward along said second scoreline and then around said first scoreline, said container neck comprising a top neck finish, external third and fourth bead means on the exterior of said neck in a position to engage said first and second bead means, and [an] *a horizontal* external shoulder positioned to fit tightly under the lower edge of said skirt to impede attempts to pry the lower edge of said skirt upward.

* * * * *